United States Patent [19]

Gilb

[11] 4,404,781

[45] Sep. 20, 1983

[54] MUD-SILL ANCHOR

[75] Inventor: Tyrell T. Gilb, Berkeley, Calif.

[73] Assignee: Simpson Strong-Tie Company, Inc., San Leandro, Calif.

[21] Appl. No.: 215,730

[22] Filed: Dec. 12, 1980

[51] Int. Cl.[3] ..... E02D 27/00

[52] U.S. Cl. ..... 52/295; 52/714

[58] Field of Search ..... 52/714, 295, 370, 300, 52/712, 715

[56] References Cited

U.S. PATENT DOCUMENTS

| | | | |
|---|---|---|---|
| 908,310 | 12/1908 | McDonald . | |
| 1,767,575 | 6/1930 | Bujack | 52/370 X |
| 2,467,115 | 4/1949 | Duggan | 72/108 |
| 3,750,360 | 8/1973 | Kingston | 52/714 |
| 3,782,058 | 1/1974 | Allen | 52/300 |
| 3,889,441 | 6/1975 | Fortine | 52/715 |
| 4,005,942 | 2/1977 | Gilb | 403/190 X |

FOREIGN PATENT DOCUMENTS

| | | | |
|---|---|---|---|
| 103929 | 5/1938 | Australia | 52/370 |

OTHER PUBLICATIONS

Mudsill Anchor, Golden Gate Equipment, Catalog, Jan. 1974.

Foundation Anchor, Silver Metal Products, Inc., Apr. 1972.

Mud Sill Anchors, Simpson Company, Sep. 1979.

*Primary Examiner*—Carl D. Friedman

*Attorney, Agent, or Firm*—James R. Cypher

[57] ABSTRACT

A singleside sheetmetal mudsill anchor for anchoring a sill plate to a concrete foundation having an embedded leg and a pair of splayed arms connected to the upper end of the leg extending outwardly to one side. The arms are adapted for bending around the sill member and have fastener openings for connecting the anchor to the sill member.

8 Claims, 7 Drawing Figures

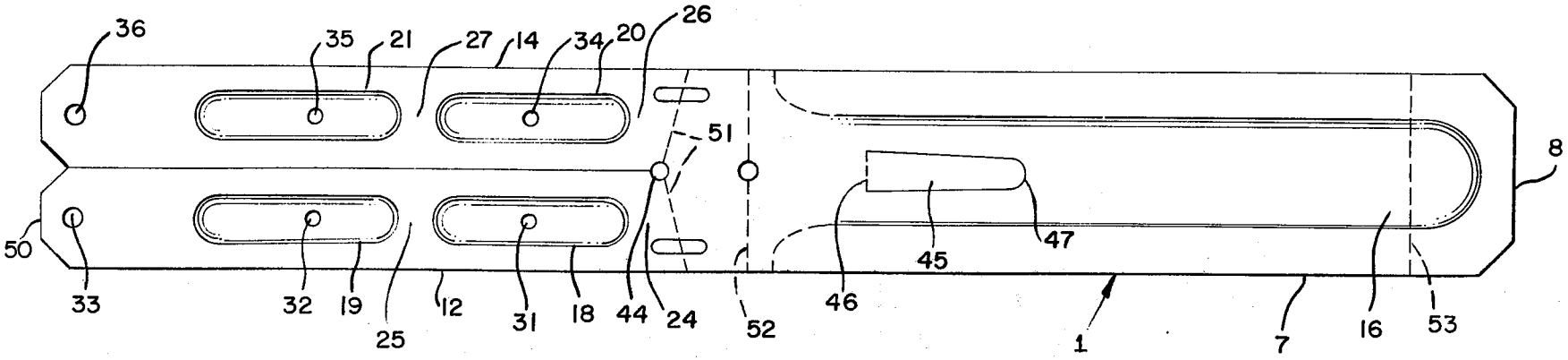
FIG. 1
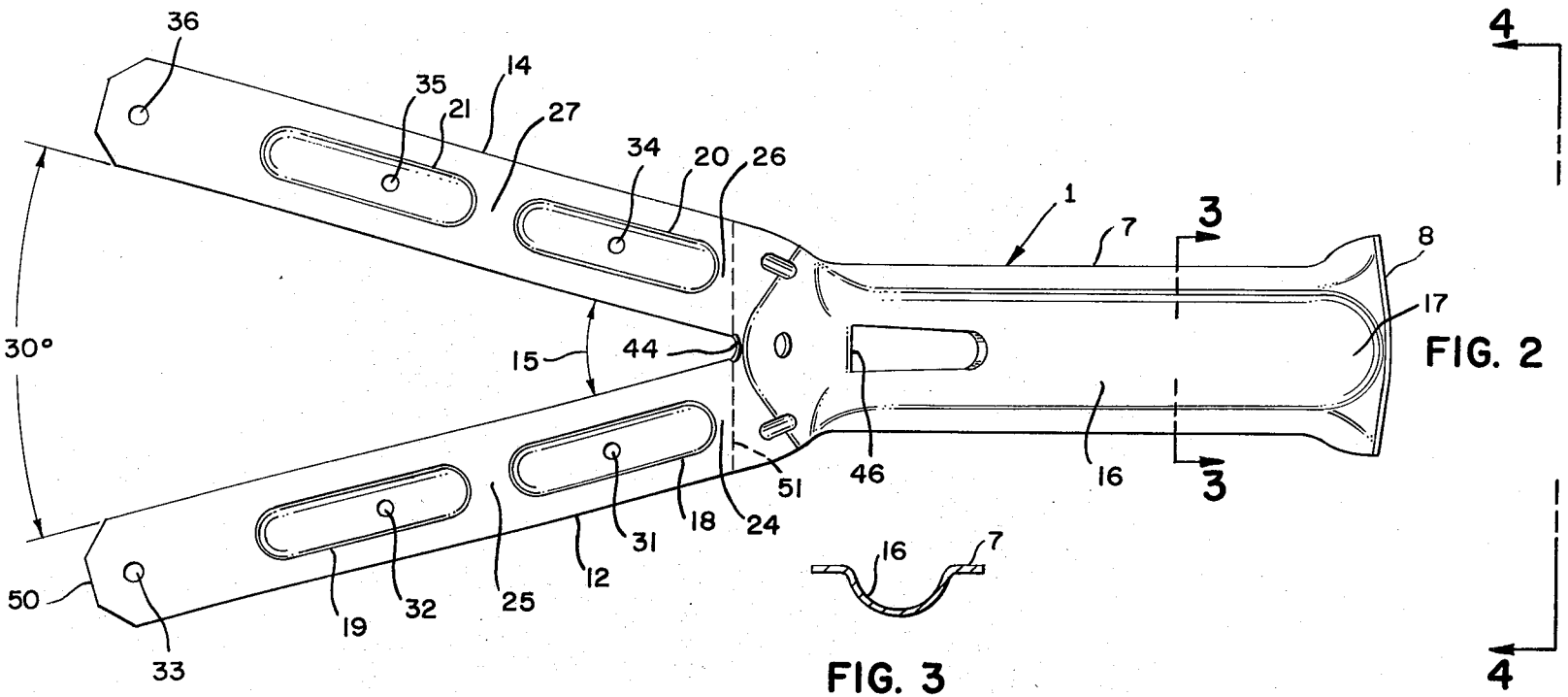
FIG. 2
FIG. 3

MUD-SILL ANCHOR

BACKGROUND OF THE INVENTION

There are several different accepted ways to attach a wood sill plate to the top of a foundation wall or slab. The oldest way is to insert threaded anchor bolts into the concrete as soon as the pour is completed and leveled off. Holes are drilled in the sill plate and the plate is then set on the foundation with the anchor bolts protruding through the openings.

Several manufacturers are offering sheet metal connectors which replace the threaded bolts. Examples of such sheet metal anchors are found in U.S. Pat. Nos. 3,889,441 and 3,750,360. Both of these patents have arms which protrude on either side of the sill plate and if a concrete slab is to be poured, the upstanding arms interfere with mechanical equipment for screeding and trowling the slab.

SUMMARY OF THE INVENTION

The anchor of the present invention totally supplants the use of anchor bolts at less than half of the installed cost of one-half inch anchor bolts.

The splayed top-attachment legs provide spacing which meets the requirements of the international conference of building officials (uniform building code) for six (6) nail attachment to the mud sill.

The heavily bossed and footed embeddment element provides full withdrawal resistance in any direction.

The mud sill anchor can be placed either prior to or immediately after the pouring of the concrete.

The unique manner in which the anchor is attached to the form provides for flat nailing attachment without requiring the nail to be removed prior to removing the form.

The anchor permits full finishing machine operation without interference from upright elements or double-nail heads.

A tab member provides placement stability when the anchor is attached to the foundation form.

After installation, the anchor has no upstanding elements and therefore a frame wall does not have to be lifted over any upstanding anchor members.

The dual arm design provides maximum attachment flexibility to mud sills of many thicknesses and widths. Further, the arm design permits placement irrespective of stud location.

The anchor is embedded in the concrete so that there is no exposed metal after the forms are stripped.

DESCRIPTION OF THE DRAWINGS

FIG. 1 is a top plan view of the sheet metal blank from which the mud sill anchor of the present invention is constructed.

FIG. 2 is a top plan view of the anchor of the present invention as constructed from the blank of FIG. 1.

FIG. 3 is a cross sectional view of a portion of the anchor taken along line 3—3 of FIG. 2.

DESCRIPTION OF THE PREFERRED EMBODIMENTS

Figure 5:
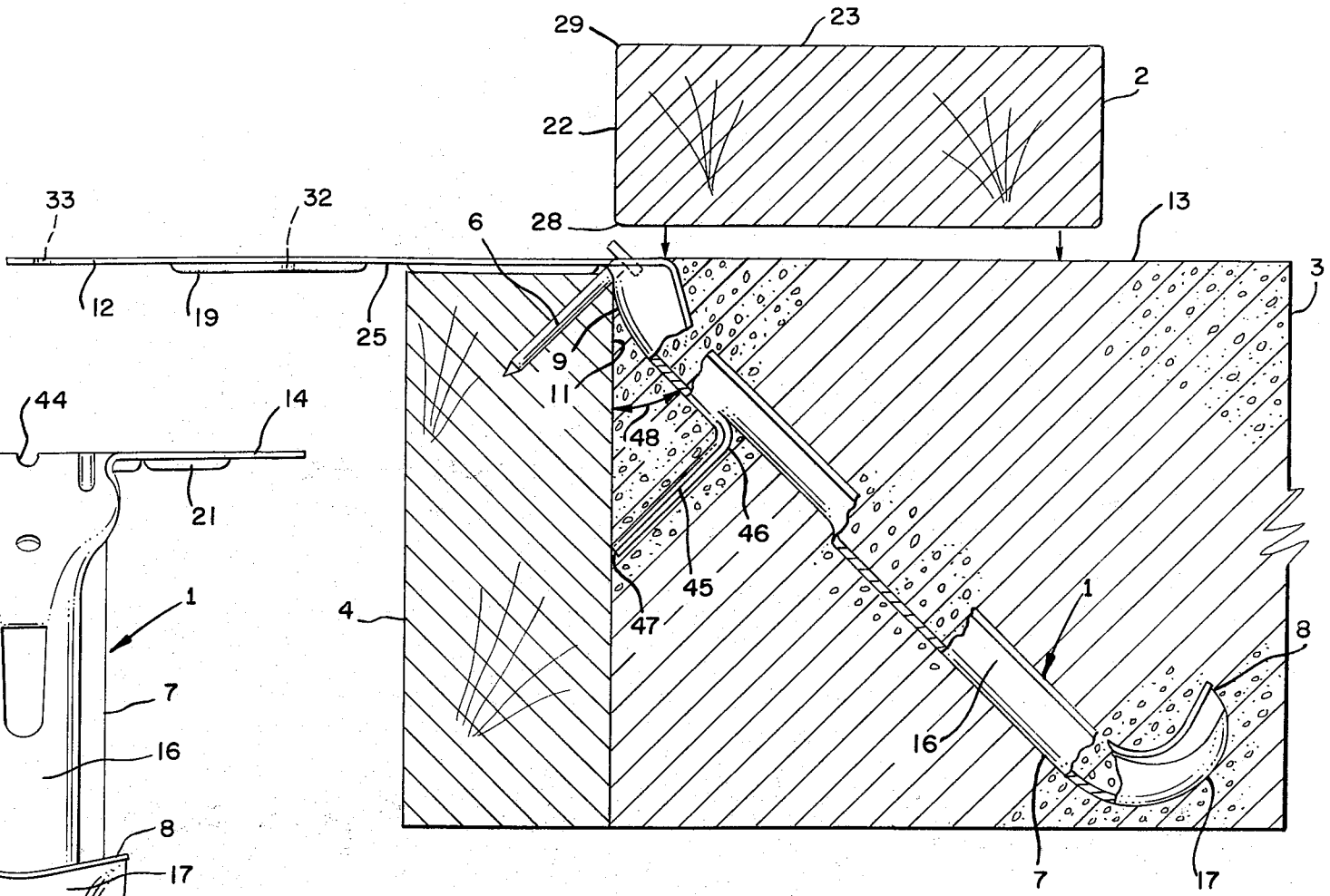
FIG. 5 is a side elevation view of the anchor with portions in cross section. The anchor is shown embedded in a concrete foundation and attached to a form board. The sill member is illustrated to show its location after the form board has been removed.
Figure 4:
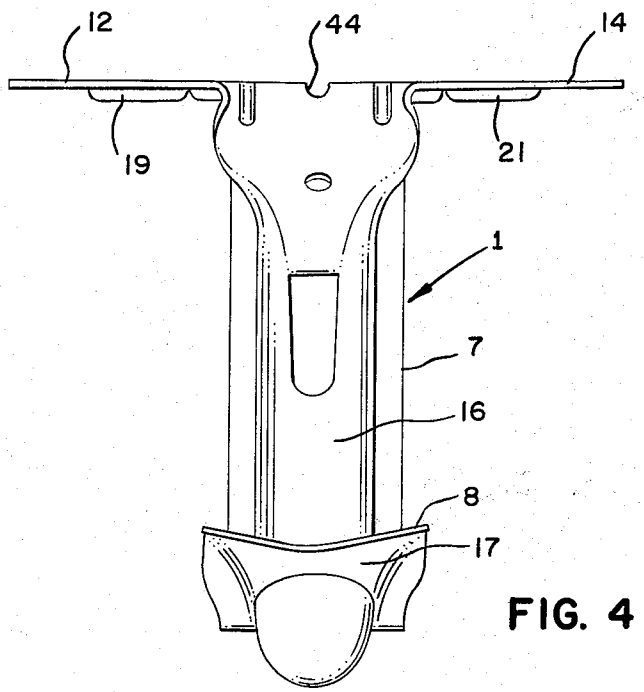
FIG. 4 is a front elevation view of the anchor shown in FIG. 2 taken in the direction of arrows 4—4 of FIG. 2.
Figure 7:
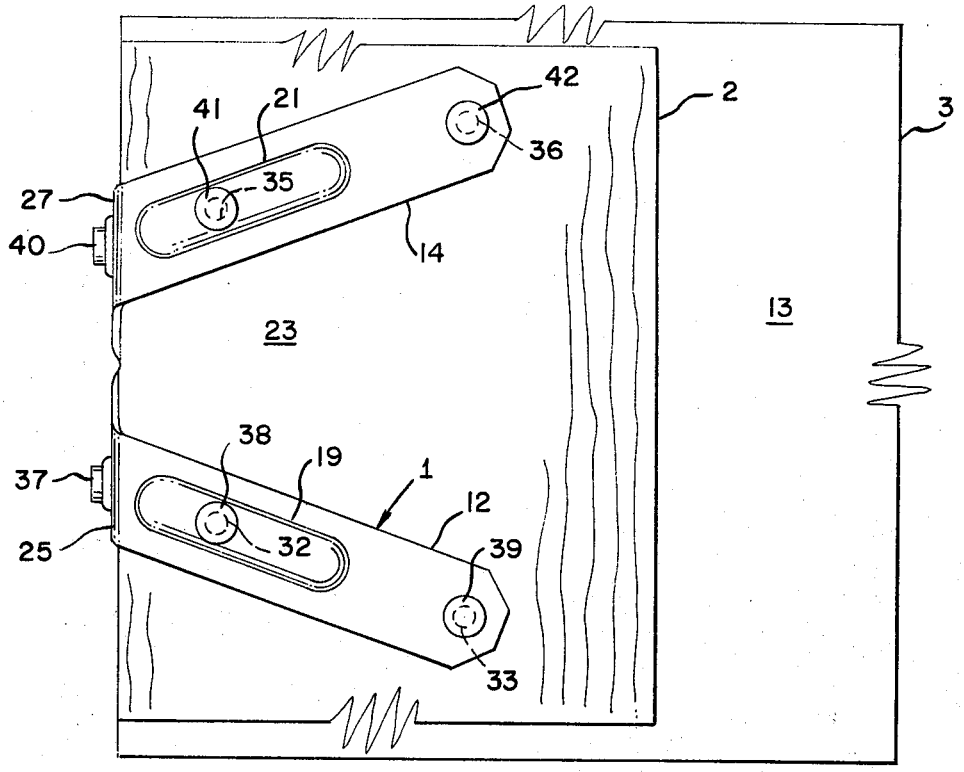
FIG. 7 is a top view of the anchor member attached to a sill member as shown in FIG. 6.
Figure 6:
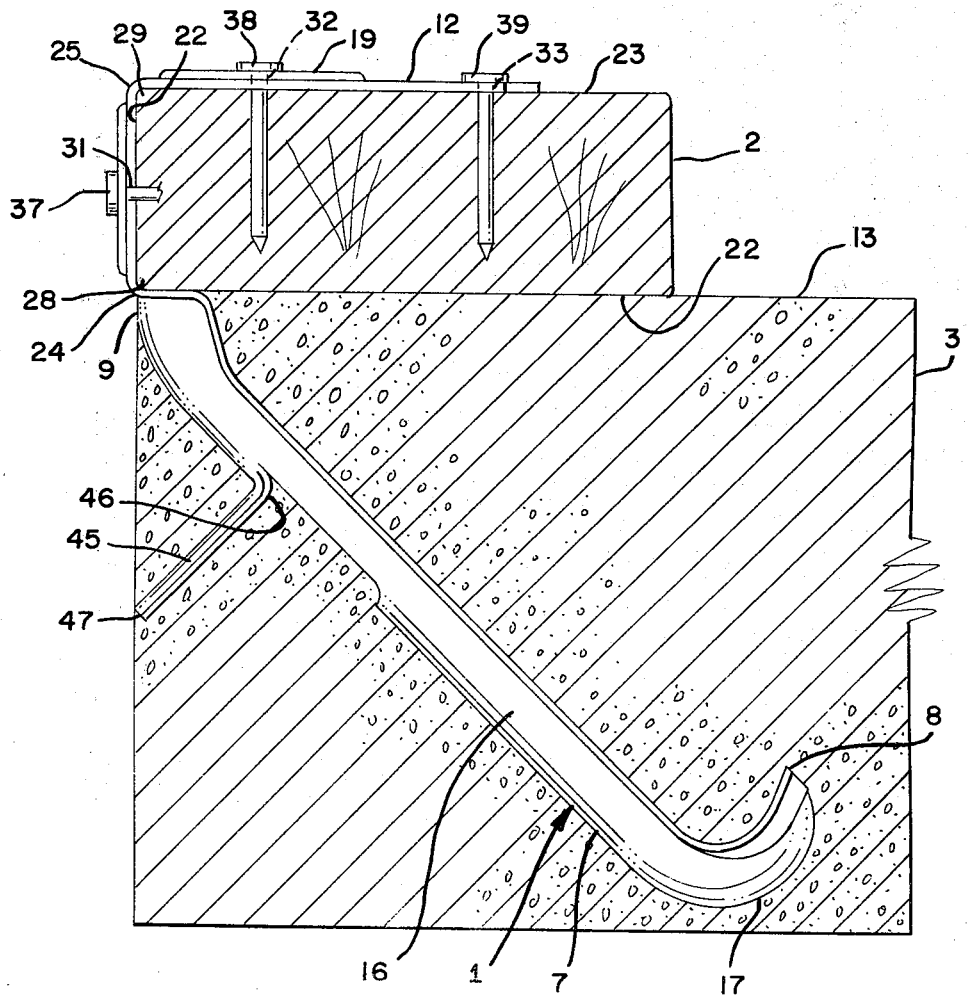
FIG. 6 is a side view of the anchor connected to the sill member. The concrete foundation is shown in cross section.

The single side sheet metal mud sill anchor 1 of the present invention is used for anchoring a sill plate 2 to a concrete foundation 3. The anchor is temporily attached to a form member 4 by means such as a nail 6. The anchor is formed from a single piece of sheet metal as illustrated in FIG. 1. The anchor consists briefly of an embedded leg 7 having a distal end 8.

The leg is positioned downwardly at an angle within the foundation and away from the form member 4. An upper end 9 is adapted for contact with the interface 11 of the form board. A first mud sill attachment arm 12 is integrally connected to the upper end of the leg and extends above and outwardly from the form board wherein the plane of the arm is generally parallel to the top surface 13 of the foundation.

A second mudsill attachment arm 14 integrally connected to the upper end of the leg extends above and outwardly from the form board in generally the same plane as the first arm but at an angle 15 thereto.

Anchor leg 7 is formed with an embossment 16 which extends substantially the length of the leg. The embossment at the upper end of the leg is adapted to engage the face of the foundation form member as indicated by the number 9.

Preferably, the distal end of the leg is formed with an angularly upturned portion 17 which increases the mechanical engagement with the foundation.

Arms 12 and 14 are formed with longitudinally aligned embossed portions 18, 19, 20 and 21.

The arms 12 and 14 each have a length selected for extending up the side edge 22 and over a substantial portion of the upper side 23 of the sill. The embossed portions 18–21 are interrupted at each of two selected bend points 24–27 which occur at the edges 28 and 29 of the sill 2.

Arms 12 and 14 are formed with fastener openings 31–36 for driving fasteners 37–42 therethrough and into the sill 2.

A restricted slot opening 44 is formed at the intersection of the arms 12 and 14 for receiving fastener 6 positioned for engaging the form member 4 and permitting the removal of the form member without withdrawing the fastener from the form.

In a modified form of the invention, a positioning tab 45 may be formed from leg 7 and bent along bend line 46 so that it extends rearwardly and engages the face 11 of the foundation form member 4. When the end 47 of tab 45 engages the face of the foundation, it cooperates with the upper end 9 of embossment 16 in positioning the anchor at a preselected angle 48 with respect to the form member 4.

As an example, referring to FIG. 1, the anchor 1 may be formed from a 16 gauge galvanized steel blank of $1\frac{1}{2}''$ section. The body portion to be embedded in concrete is $5\frac{5}{8}''$ long, with $\frac{3}{4}''$ boss$\times$5/16″ draw depth, terminating in a 1″ bossed hook element overbent to 110 degrees. A $1\frac{1}{8}''\times$5/16″ tapered positioning tab is provided, $1\frac{1}{8}''$ down at 90°, for form standoff positioning purposes when the unit is installed at the required 45° angle. Installed, the vertical embedded depth is four (4) inches.

The upper body is split into two (2) legs $4\frac{3}{4}''$ long, each having two bosses and three 0.156" diameter holes for **10*d*** nails. The transfer form bend between the lower body and the legs is such that the legs are die form-spread 30°.

Installation assumes concrete having a minimum compressive strength of 2,000 pounds per square inch at 28 days, with spacing and other location control in accordance with Section 2907(e) of the code, where used to replace foundation bolts. The legs are so configured as to provide code-spaced nailing for six (6) 10d or N10 10 ($1\frac{1}{2}''$ long) nails when attached to mudsills of 2×4, 3×4, 2×6, 3×6 of like dimensions, including special conditions when one of the legs is disposed upwards at a stud location.

Installation is permitted whenever not less than four (4) inches of concrete depth is provided. If such depth is over a horizontal cold joint such as to a concrete foundation wall, or foundation wall formed of concrete block, then separate means must be provided as required for connecting the elements adjacent to the horizontal cold joint.

The anchor has been ICBO tested and has been formally approved for the following values:

| MUDSILL SIZES: | | NAILING SCHEDULE: | |
|---|---|---|---|
| 2 × 4, 3 × 4<br>2 × 6, 3 × 6 | | 6 - 10 d or<br>6 - N10 (×$1\frac{1}{2}$") | |
| ALLOWABLE LOAD (in pounds) 1.2 | | | |
| UP-LIFT | PARALLEL TO MUDSILL | PERPENDICULAR INTO MUDSILL | PERPENDICULAR OUT TO MUDSILL |
| 990 | 720 | 1080 | 937 |

1. Loads are for Douglas fir-larch or Southern pine. For other species adjust on the basis of relative group classification in accordance with U.B.C. Standard No. 25-17.
2. The loads are not subject to increase for duration of load.

I claim:

1. A singleside sheetmetal mudsill anchor for anchoring a wood mudsill plate to a concrete slab foundation comprising:

a. a concrete slab foundation having a perimeter;

b. a nailable form board member having an inner face temporarily placed in contact with a portion of said perimeter of said concrete slab foundation;

c. said anchor includes an embedded leg having a distal end embedded at an angle to the top of said slab and positioned downwardly within said slab foundation and inwardly from said slab perimeter and having an upper end positioned in contact with said inner face of said form board;

d. said anchor having a first mudsill attachment arm integrally connected to said upper end of said leg and extending above and outwardly from said form board and outside said perimeter of said concrete slab foundation wherein the plane of said arm is generally parallel to the top surface of said foundation;

e. said anchor having a second mudsill attachment arm integrally connected to said upper end of said leg and extending above and outwardly from said form board and outside said perimeter of said concrete slab foundation in generally the same plane as said first arm and at an angle of substantially less than 180° thereto;

f. a wood mudsill member positioned on said concrete slab perimeter edge when said concrete hardens;

g. said first and second mudsill attachment arms have a selected length for bending over said mudsill member from the same side of said mudsill and then over a portion of the top of said mudsill member; and h. fastener means connecting said first and second arms to the top side of said mudsill member.

2. An anchor as described in claim 1 wherein:

a said leg is formed with an embossment extending substantially the length of said leg; and b. said embossment at the upper end of said leg is positioned in engagement with said inner face of said foundation form member.

3. An anchor as described in claim 1 wherein:

a. said distal end of said leg is formed with an angularly upturned portion for increased mechanical engagement with said foundation.

4. An anchor as described in claim 1 wherein:

a. each of said arms are formed with a plurality of longitudinally aligned and spaced embossed portions said spaces between embossments forming areas where said arms may be easily bent.

5. An anchor as described in claim 4 wherein:

a. said arms each have a length selected for extending up the side edge and over a substantial portion of the upper side of said sill; and b. said embossed portions of each of said arms are interrupted at each of two selected bend points which occur at the edges of said sill.

6. An anchor as described in claim 5 wherein:

a. said arms are formed with fastener openings adapted for driving fasteners therethrough and into said sill.

7. An anchor as described in claim 1 wherein:

a. a restricted slot opening is formed at the intersection of said arms for receiving a fastener adapted for engaging said form member and permitting the removal of said form member without withdrawing said fastener from said form.

8. A singleside sheetmetal mudsill anchor for anchoring a sill plate to a concrete slab foundation wherein the anchor is temporarily attached to a form member formng said foundation and said anchor being formed from a single piece of sheetmetal and comprising:

a. a concrete slab foundation having a generally horizontal top surface and a perimeter;

b. a nailable form board member having an inner face temporarily placed in contact with a portion of said perimeter of said concrete slab foundation;

c. an embedded leg having a distal end embedded at an angle to the top of said slab and positioned downwardly within said slab foundation and inwardly from said slab perimeter and having an upper end positioned in contact with the inner face of said form board;

d. a first mudsill attachment arm integrally connected to said upper end of said leg and extending above and outwardly from said form board wherein the plane of said arm is generally parallel to the top surface of said foundation;

e. a second mudsill attachment arm integrally connected to said upper end of said leg and extending above and outwardly from said form board in generally the same plane as said first arm but at an angle thereto;

f. said leg is formed with an embossment extending substantially the length of said leg;

g. said embossment at the upper end of said leg is positioned in engagement with said inner face of said foundation form member;

h. a positioning tab formed from said leg and extending therefrom and positioned in engagement with said inner face of said foundation form member for cooperating with said embossment at the upper end of said leg to automatically position said anchor at a preselected angle with respect to said top surface of said slab member;

i. said first and second mudsill attachment arms have a selected length for bending over said mudsill member from the same side of said mudsill and then over a portion of the top of said mudsill member; and j. fastener means connecting said first and second arms to the top side of said mudsill member.

* * * * *